United States Patent [19]

Brander

[11] Patent Number: 4,593,661

[45] Date of Patent: Jun. 10, 1986

[54] HEAT SINK FOR AN INTERNAL COMBUSTION ENGINE

[76] Inventor: S. L. Brander, 1456 E. Phila., Space 329, Ontario, Calif. 91761

[21] Appl. No.: 780,698

[22] Filed: Sep. 26, 1985

[51] Int. Cl.[4] ..... F01M 1/00

[52] U.S. Cl. ..... 123/196 AB; 123/90.38; 123/195 C; 184/104.3

[58] Field of Search ..... 123/195 C, 198 E, 196 AB, 123/90.38; 184/104 B, 104 R

[56] References Cited

U.S. PATENT DOCUMENTS

| | | | |
|---|---|---|---|
| 1,108,265 | 8/1914 | Spacke et al. | 123/90.38 |
| 1,731,016 | 10/1929 | Lehman | 123/41.4 |
| 2,020,570 | 11/1935 | Pettit | 123/196 AB |
| 2,225,102 | 12/1940 | Daub | 123/90.38 |
| 3,456,759 | 7/1969 | Henry-Bigbaud | 123/90.38 |
| 3,521,613 | 7/1970 | Celli | 123/90.38 |
| 4,022,272 | 5/1977 | Miller | 123/196 AB |
| 4,150,655 | 4/1979 | Gaggiano et al. | 123/196 AB |
| 4,164,927 | 8/1979 | Congram et al. | 123/90.38 |
| 4,300,511 | 11/1981 | Lang | 123/90.38 |
| 4,388,898 | 6/1983 | Larson | 123/90.38 |

*Primary Examiner*—E. Rollins Cross

*Attorney, Agent, or Firm*—Norman B. Rainer

[57] ABSTRACT

A device for enhancing the removal of heat from an internal combustion engine utilizes an aluminum plate seated within a matching aperture in the upper portion of an otherwise conventional valve cover panel. The combined plate and valve cover panel form an oil retaining chamber positioned above the valves of the engine. Projections such as vanes integral with upper and lower surfaces of the plate further enhance the conduction of heat away from the engine.

9 Claims, 4 Drawing Figures

HEAT SINK FOR AN INTERNAL COMBUSTION ENGINE

BACKGROUND OF THE INVENTION

This invention relates to heat dissipating means for an internal combustion engine, and more particularly concerns heat conducting means mounted atop an internal combustion engine in association with the valve cover for said engine.

All internal combustion engines are provided with cooling systems which remove a major portion of the heat generated by the combustion of the fuel. Such cooling systems are of two general types, namely air-cooled systems wherein vanes on the exterior of the engine convectively transfer heat to air which is either forced past said vanes or is in passive contact therewith; and liquid cooled systems wherein a fluid coolant is circulated through channels within an engine block adjacent the cylinders. Air-cooling is generally restricted to engines of relatively low horsepower unless very special design considerations are incorporated. Although some heat is radiated from the exterior surface of an engine to the ambient air, such mode of heat removal is usually of minimal significance for proper engine operation.

The intake and exhaust valves which service the cylinders of a four stroke engine are particularly vulnerable to the effects of engine over-heating because the tapered seating peripheries of the valve heads are thin and susceptible to burning and malformation. The effects of uneven overheating of the valve heads further produces warping with consequent uneven seating. The valves are generally accessible on the exterior of the engine block, and are protected by a valve cover panel which makes an impervious fit with the engine block to form an oil-retaining chamber that engulfs said valves. Earlier attempts to remedy the problems of valve overheating have required extensive redesign of either the engine block or the valve cover panel, or have caused difficulty in gaining access to the valves.

It is accordingly an object of the present invention to provide heat-dissipating means for use in a four stroke internal combustion engine.

It is a further object of this invention to provide heat-dissipating means as in the foregoing object in the form of a device capable of easy installation in association with a valve cover panel of said engine.

It is another object of the present invention to provide a heat dissipating device of the aforesaid nature which facilitates access to said valves.

It is a still further object of the present invention to provide a heat-dissipating device of the aforesaid nature of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by a heat dissipating device comprising:

a) an aluminum plate of integral monolithic construction having an upper surface of generally elongated substantially rectangular periphery, a bottom surface whose outer periphery is inwardly displaced from the periphery of the upper surface, and a boundary edge intervening between said surfaces and comprised of a shulder extending outwardly from said upper surface as a continuous integral extension thereof, and a sidewall perpendicularly disposed between said shoulder and bottom surface and defining the periphery of said bottom surface, and at least four channels extending normally through said shoulder at sites adjacent the opposed extremities of the plate, b) continuous resilient sealing means associated with the underside of said shoulder, and c) a valve cover panel having an upper surface having an aperture therein which closely conforms to the periphery of the bottom surface of said plate, permitting insertive engagement of said bottom surface and sealing engagement with said shoulder.

The channel are adapted to accomodate threaded posts which ordinarily extend from an engine block for the purpose of holding the valve cover panel. The sealing means are preferably gasket material of conventional nature held in place by adhesives generally utilized with such gaskets. The aperture in the upper surface of the valve cover panel is positioned in a manner so as to provide easy access to valve adjustment means located in the engine block covered by said panel. By virtue of such arrangements of components, a mechanic can easily remove the plate to reach and adjust the valves of the engine.

The heat dissipating effect of the plate device of this invention is accomplished not only because of the design and placement of the device, but also because of the much higher thermal conductivity of aluminum in comparison with the iron of which the engine block is fabricated. Specifically, the coefficient (1) of heat conductivity, given in calories/cm. sec. degree C, is 0.49 for aluminum at 100° C., and 0.14 for low carbon steel at 100° C. Such values of (1) express the quantity of heat in gram calories transmitted per second through a plate of the material one centimeter thick and one square centimeter in area wherein the temperature difference between the two sides of the plate is one degree centigrade. Accordingly, it is seen that aluminum is 3.5 times better a conductor of heat than iron. In a preferred embodiment of the invention, heat-dissipating vanes may be provided on both surfaces of the aluminum plate.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
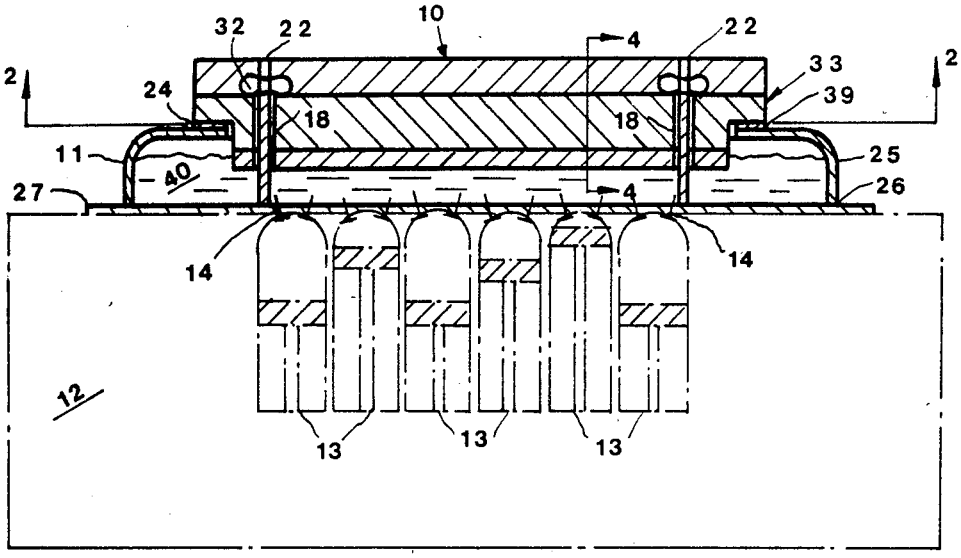
FIG. 1 is a sectional side view of an embodiment of the heat dissipating device of this invention, shown in operative association with a cylinder block of a four cycle internal combustion engine.
Figure 2:
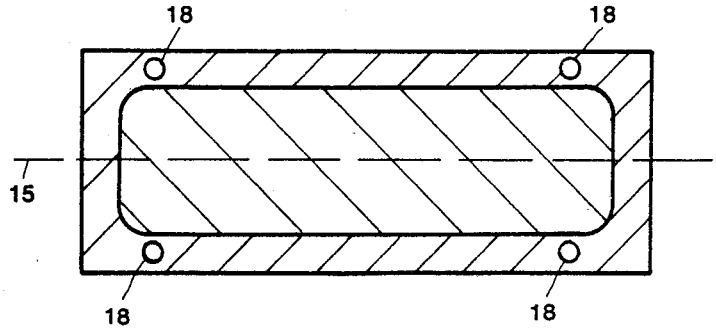
FIG. 2 is a sectional view taken on the line 2—2 of FIG. 1.
Figure 3:
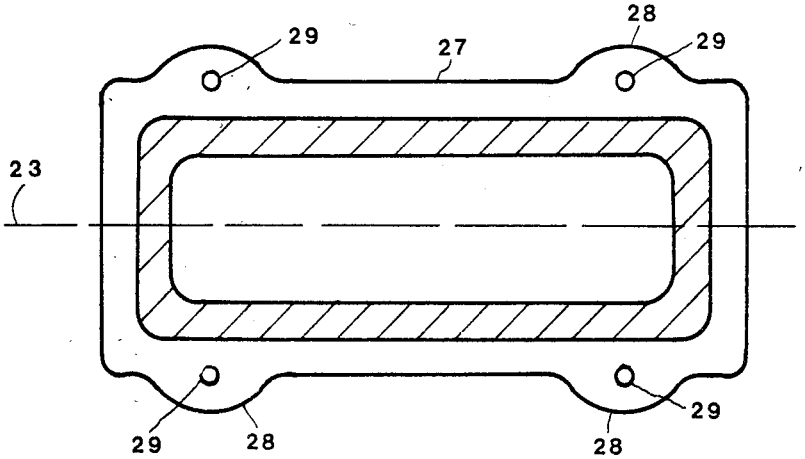
FIG. 3 is a top view of the valve cover panel component of FIG. 1 with the aluminum plate removed therefrom.
Figure 4:
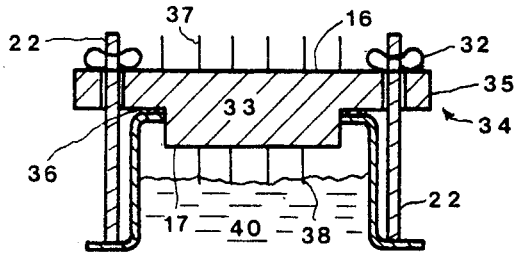
FIG. 4 is a sectional view taken along the line 4—4 of FIG. 1.

For convenience in description, the terms "upper" and "lower", or words of similar import, will have reference to the upper and lower extremities, respectively, of the invention as shown in FIG. 1.

DESCRIPTION OF THE PREFERRED EMBODIMENT

Referring to FIG. 1, an embodiment of the heat dissipating device 10 of the present invention is shown in operative association with the engine block 12 of a four cycle internal combustion engine having six in-line cylinders 13, valves 14 adjacent the upper extremity of the block, and upwardly directed threaded posts 22. The device 10 is comprised of aluminum plate 33 positioned atop modified valve cover panel 11.

Plate 33 is of integral monolithic construction, having a rectangular periphery elongated about center axis 15, an upper surface 16, a bottom surface 17 whose outer periphery is inwardly displaced from the periphery of the upper surface, and a boundary edge 34 intervening between said surfaces. Said boundary edge is comprised of shoulder 35 extending outwardly from said upper surface as a continuous integral extension thereof, and sidewall 36 perpendicularly disposed between said shoulder and bottom surface, and defining the periphery of said bottom surface. At least four channels 18 extend normally through said shoulder at sites adjacent the opposed extremities of the plate. A series of parallel heat dissipating vanes 37 rise perpendicularly from said upper surface, and a similar array of vanes 38 extends downwardly from said bottom surface. In alternative embodiments, the vanes may be replaced by thermally conductive bristles which may be cut by shears to secure customized fitting of the plate.

Valve cover panel 11 is an integral member of inverted hull type configuration elongated about center axis 23, having a top portion 24, surrounding sidewall 25, lower extremity 26 and a flat circumferential flange 27 extending from said lower extermity in substantially perpendicular disposition to sidewall 25. The flange is provided with four ears 28 containing apertures 29 adapted to accept threaded posts 22. The spacing of aperatures 29 is identical to the spacing of channels 18 of said plate, thereby permitting vertical registration of said apertures and channels to facilitate insertive engagement of posts 22. Although the illustrated embodiment shows only four threaded posts 22 with associated channels 18 and apertures 29, other embodiments may have six or more threaded posts adapted to engage the valve cover panel and aluminum plate. A flat gasket of conventional design (not shown) is generally disposed beneath flange 27 to make sealing abutment with the engine block. A single aperture 30 is provided within the top portion 24 of the valve cover panel centered upon axis 23 and having a size and configuration adapted to permit close-fitting penetration by lower surface 17 of the aluminum plate.

When the aluminum plate is drawn into close fitting contact with the top portion of the valve cover by means of wing nuts 32 acting upon posts 22, impervious sealing engagement therebetween is assured by intervening gasket 39 lying in abutment between the underside of shoulder 35 and the top portion of the valve cover panel. By virtue of such sealing relationship, a reservoir of lubricating oil 40 is maintained within the valve cover panel. Aperture 30 is positioned above those portions of the engine block where a mechanic can reach valve-adjustment means with an elongated hand tool. Accordingly, in making such valve adjustments, the mechanic merely removes the aluminum plate held in place by wing nuts 32. Different sizes of the heat dissipating device may be made available to accommodate engines of different sizes. The device of this invention accommodates smog control devices which may be associated with the upper portion of the engine block.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A heat dissipating device adapted to be mounted atop an internal combustion engine having upright threaded posts adapted to accommodate a valve cover panel, said device comprising:
   a) an aluminum plate of integral monolithic construction having an upper surface of generally elongated subsantially rectangular periphery, a bottom surface whose outer periphery is inwardly displaced from the periphery of the upper surface, and a boundary edge intervening between said surfaces and comprised of a shoulder disposed above and extending outwardly from said bottom surface, a sidewall perpendicularly disposed between said shoulder and bottom surface and defining the periphery of said bottom surface, and at least four channels extending normally through said shoulder at sites adjacent the opposed extremities of the plate,
   b) continuous resilient sealing means associated with the underside of said shoulder, and
   c) a valve cover panel having an upper surface having an aperture therein which closely conforms to the periphery of the bottom surface of said plate, permitting insertive engagement of said bottom surface and sealing engagement with said shoulder.

2. The device of claim 1 wherein thermally conductive projections are associated with said upper and bottom surfaces.

3. The device of claim 2 wherein said projections are thin vanes positioned in a parallel array and perpendicularly disposed to said surfaces.

4. The device of claim 2 wherein said projections are of wire-like configuration.

5. The device of claim 2 adapted to form an oil-retaining enclosure above the valves of said engine.

6. The device of claim 4 wherein the projections associated with said bottom surface are of a size adapted to be immersed within said oil.

7. The device of claim 1 wherein said four channels are adapted to be penetratively engaged by the upright threaded posts of the engine.

8. An engine equipped with the device of claim 6, said device being held in sealing contact with said engine by threaded fasteners engaging said threaded posts and in tight abutment with the upper surface of said plate.

9. The engine of claim 7 wherein said engine is a four cycle piston-driven gasoline operated engine.

* * * * *